United States Patent [19]

Terral

[11] Patent Number: 4,813,730

[45] Date of Patent: Mar. 21, 1989

[54] RETRIEVAL DEVICE FOR A WELL CONTROL TOOL

[76] Inventor: Ben D. Terral, 118 Timberwilde, Huntsville, Tex. 77340

[21] Appl. No.: 64,872

[22] Filed: Jun. 19, 1987

[51] Int. Cl.[4] ..... E21B 31/20

[52] U.S. Cl. ..... 294/86.25; 294/86.1; 166/217

[58] Field of Search ..... 294/86.1, 86.12, 86.17, 294/86.24, 86.25, 86.3, 86.31, 86.33, 93, 94, 96; 166/98, 124, 125, 137, 138, 215, 217

[56] References Cited

U.S. PATENT DOCUMENTS

| | | | |
|---|---|---|---|
| 342,462 | 5/1886 | Reichardt | 294/86.17 |
| 505,262 | 9/1893 | Bowen | 294/86.25 |
| 1,776,776 | 9/1930 | Blackmarr | 294/86.33 X |
| 2,261,564 | 11/1941 | Robichaux et al. | 294/86.25 X |
| 2,542,679 | 2/1951 | Kemnitz | 294/86.24 |

*Primary Examiner*—Johnny D. Cherry

*Attorney, Agent, or Firm*—Keaty & Keaty

[57] ABSTRACT

A latching device for locking and removal of a flow control device from a mandrel receiver comprises a cylindrical stem, a locking sleeve slidably mounted upon the stem, an annular locking ring mounted for a limited axial movement along the lower portion of the locking sleeve and a compression spring. The annular locking ring has upper and lower bevel surfaces which are complementary to bevel surfaces of a mandrel receiver. An improved retrieval device is disclosed for retrieval of a valve which is locked within the mandrel receiver, the device comprising a cylindrical body having a central opening and an internal wall with a recess and a retrieval tool provided with a compressible C-shaped ring for locking engagement with the recess formed in the cylindrical body, thereby allowing retrieval of the cylindrical body, along with the well tool which is securedly attached to the retrieval device.

9 Claims, 5 Drawing Sheets

RETRIEVAL DEVICE FOR A WELL CONTROL TOOL

BACKGROUND OF THE INVENTION

1. Field of the Invention

The present invention relates to latches for retrievable flow control devices used in oil and gas industries, and more specifically to latches which are utilized to secure or to remove a flow control valve from a mandrel receiver at a subterranean location.

The use of various type latches for such purposes is well known in the oil and gas industries. However, many latches which are currently utilized in the field suffer from a major drawback: the locking ring, in many instances, "wedges" against the locking shoulder of a mandrel, which leads to bending and metal damage of the flow control device or the mandrel receiver, and as a result, to inability of the latching device to secure position of the valve in the mandrel receiver.

Another problem which is often encountered in the oil and gas industries is inability of a retrieval tool to retrieve a valve which is locked downhole. Under these circumstances, all pulling means are usually carried up to the surface, while the valve has only one direction which it can be moved-upward. The valve cannot be retrieved by driving it down through the mandrel and at the present time, the tubing is usually pulled to the surface so that the valve, in such emergency situations, can be retrieved. While such procedure could be acceptable for production on land, no similar benefit could be obtained at an offshore location. A drilling rig will have to be moved away from that particular location and the well will stay dormant until a next workover program is effected which can take as long as five to six years from the time the well is immobilized. This causes not only loss of some pieces of equipment, but what is more important, loss of production time.

SUMMARY OF THE INVENTION

The present invention is designed to solve both of the problems in a simple and straightforward manner. A latching device, in accordance with the present invention, is provided with a cylindrical body, a locking sleeve mounted in surrounding and slidable relationship on the body, a locking ring and a compressible spring which normally urges the locking ring downward so that it rests on top the latch sub which is attached to a flow control device, such as a valve. To prevent wedging of the locking ring against the locking shoulder of the mandrel receiver, the locking ring comprises upper and lower bevelled surfaces which are complementary to the bevelled surfaces of the locking shoulder of the mandrel receiver, so that the surfaces can meet at a common plane when the latching device is driven into the mandrel receiver or pulled up to the surface.

To facilitate retrieval of a flow control device, such as a valve, when all retrieval means have been carried out to the surface or the well is immobilized, the present invention provides for the use of a cylindrical latching sub having a central opening, the internal wall of which is provided with an internal recess above the means of attachment of the latch sub to a latching device, for example. A retrieval tool comprises an upper body and a lower nose portion, and a compressible C-shaped ring is mounted on the nose portion, so that it compresses while the nose portion is being driven into the central opening of the cylindrical latch sub and releases when it reaches the internal recess, thereby effectively locking the retrieval tool within the latching device. The latch sub has also means for secure attachment of the latch sub to the flow control device to be retrieved.

It is therefore an object of the present invention to provide a latching device for positioning and removal of a flow control device from a tubular receiver.

It is a further object of the present invention to provide a latching device with means which prevent wedging of the locking means of the latching device against locking shoulder of the tubular receiver.

It is a further object of the present invention to provide a retrieval tool for retrieval of a flow control device from a tubular receiver when the flow control device is locked downhole and all pulling means have been carried up to the surface.

DETAILED DESCRIPTION OF THE PREFERRED EMBODIMENT

Figure 1:
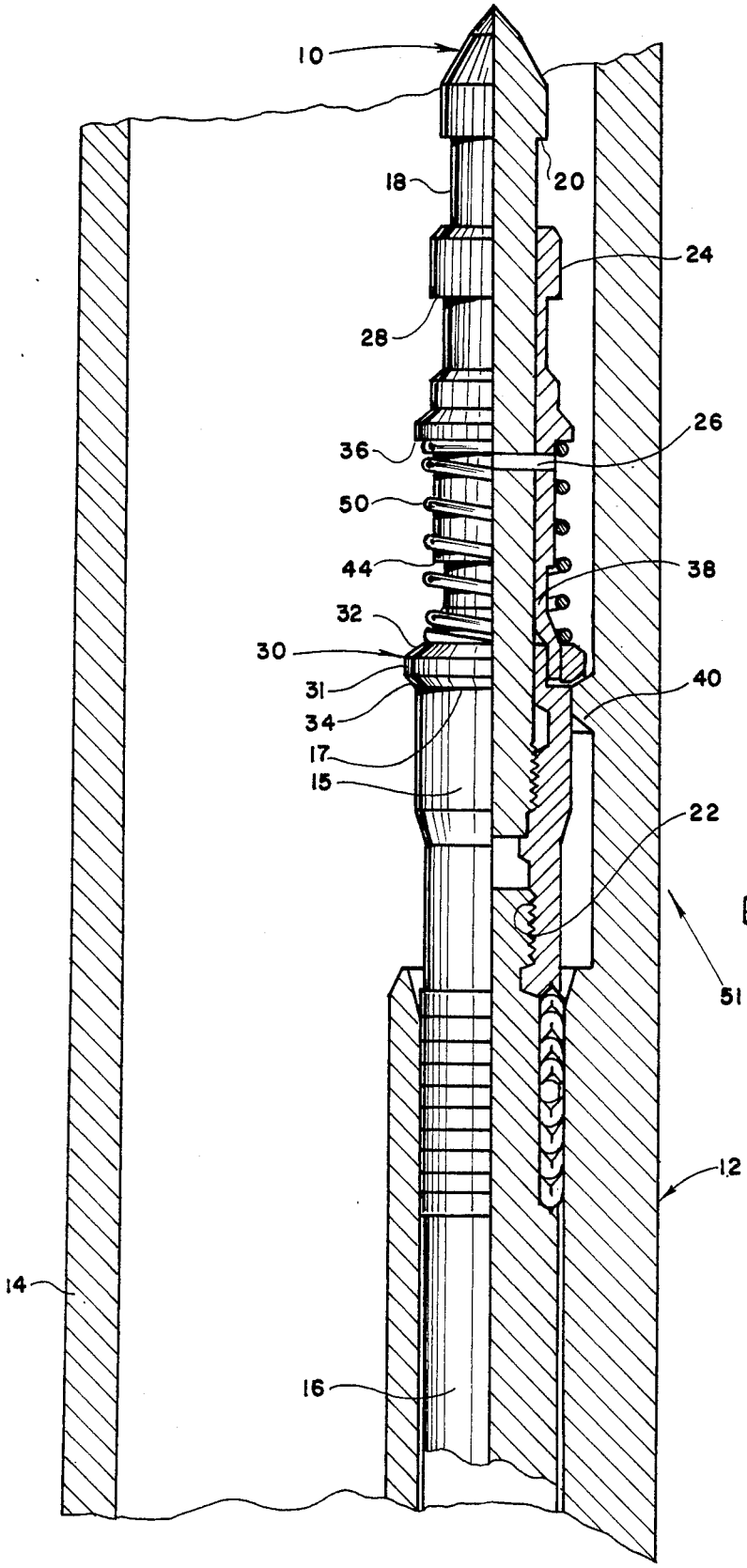
FIG. 1 is an elevational view, partially in cross section, showing the locking ring meeting the locking shoulder of the tubular receiver by a complementary bevelled surface.
Figure 4:
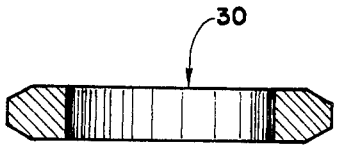
FIG. 4 is an elevational, partially cross sectional view of a locking ring in accordance with the present invention.

Referring now to the drawings, numeral 10 designates the latch of the present invention adapted for use in a side pocket 12 of mandrel 14 in which a flow control device 16, such as a valve, is mounted.

The latch 10 comprises a generally cylindrical body 18 having a shoulder 20 at its upper portion for engagement with a running tool (not shown) designed for positioning the flow control device 16 in the side pocket 12. The lower portion of the latch 10 is provided with threads 22 for threaded engagement with the flow control device 16.

A locking sleeve means 24 is slidably mounted on the cylindrical body 18, and a shear pin means 26 serves to temporarily secure the locking sleeve 24 in its lowermost position in relation to the flow control device 16.

Retrieval of the latch 10 and the flow control device 16 can be achieved through the use of a conventional retrieval tool (not shown) which will engage an upper shoulder 28 at the upper portion of the locking sleeve 24 and, by application of an upwardly directed force, will cause shearing of the pin 26 and movement of the slidable locking sleeve 24 upward in relation to the cylindrical body 18, thus allowing retrieval of the latch 10 and the flow control device 16 which is threadably engaged with the latch 10.

An annular locking ring means 30 is slidably mounted on the sleeve 24 and is provided with upper and lower beveled surfaces, designated by numerals 32 and 34, respectively. The angle of the bevel is designed to be complementary and to substantially match an angle on a latch lug 40 of the side pocket 12. The advantages of such design are such that there is no "wedging" effect of the ring 30 against the latch lug 40 when a downward force is applied to the flow control device 16, pushing it into the side pocket 12. A progressive downward movement of the flow control device 16, as was noted above, can even cause bending of the flow control device 16 which is, for example, a valve, when the angles of bevel of the locking ring 30 and the latch lug 40 are mismatched, as is the case with the currently used in the field latching devices.

When such devices are used and the bevels of the locking ring and of the latch lug do not match, there is one point of contact between a lower bevel surface of the locking ring and an upper bevel surface of the latch lug. The latch lug "digs" into the locking ring, causing wedging and even occasional bending of the valve which is being pushed downwardly into a side pocket of a mandrel. In this case, the force which acts upon the beveled surfaces is almost perpendicular to the vertical movement of the latch.

In the case of the complementary, matching angle bevels, in accordance with the present invention, the force acting upon the bevel surfaces is at an acute angle to the vertical. The direction of force acting upon the bevel surfaces in accordance with the present invention is shown by arrow 51 in FIG. 1 of the drawings. The point of contact of the beveled surfaces moves towards the center of the annular locking ring 30, causing the complementary bevelled surfaces to meet at a common plane. Such advantage is not achieved by any other currently used latch known to the applicant.

A spring means 50 is mounted circumferentially about the outside lower portion of the slidable locking sleeve 24, the spring acting against an intermediate shoulder 36 and the annular locking ring 30. The spring 50 serves to retain the position of the locking ring 30 in relation to the flow control device 16, urging the locking ring 30 to rest atop the upper edge 17 of the flow latch sub 15.

Figure 2:
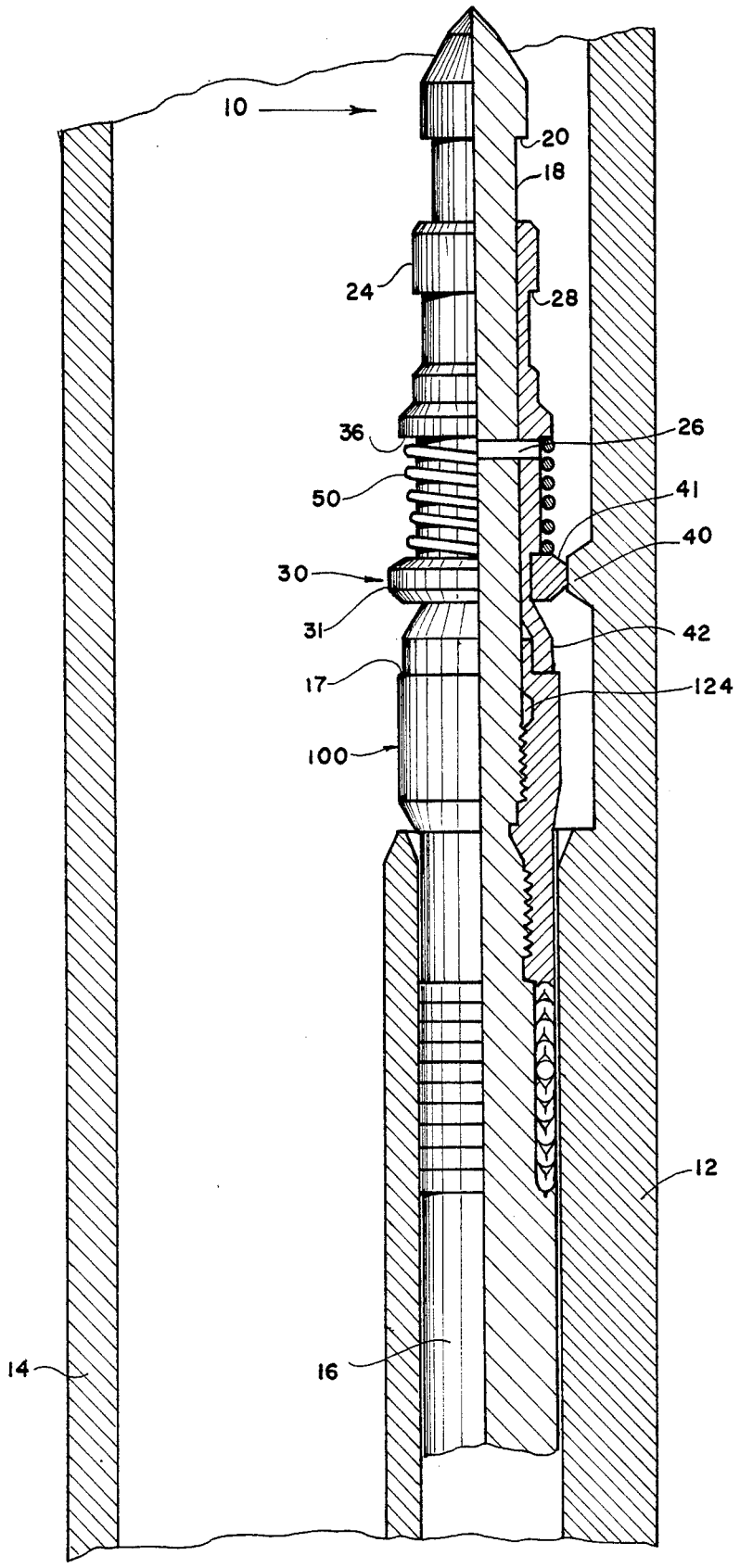
FIG. 2 is an elevational view, partially in cross section, showing the position of the locking ring, when it meets by its flat surface a respective flat surface of the locking shoulder of a tubular receiver.

FIG. 2 shows a progressive movement of the latch 10 downwardly and the locking ring 30 contacting a flat surface 41 of the latch lug 40 by its corresponding flat surface 31.

The spring 50 is compressed by the locking ring 30 which forces it upwardly. At the same time, the locking ring 30, having an internal diameter greater than an outside diameter of the body 18 and of an enlarged diameter head 42 of the locking sleeve 24, is forced sideways, laterally, to a limited degree, by the flat surface 41 of the latch lug acting upon the flat surface 31 of the locking ring 30.

The limited degree of the lateral, sideways movement of the locking ring 30 is made possible by the provision of a reduced diameter portion 38 on the sleeve 24, the portion 38 being formed above the enlarged diameter head 42 of the lower portion of the locking sleeve 24.

A lower shoulder 44 is formed above the reduced diameter portion 38 and, being of a greater diameter than the internal diameter of the locking ring 30, limits its upper movement along the locking sleeve 24 when the locking ring 30 is engaged by the latch lock 40 and the spring 50 is compressed. The vertical distance of the reduced diameter portion 38 is at least as great as the thickness of the locking ring 30 to prevent any wedging effect between the locking ring 30 and the latch lug 40. Still, the outside diameter of the locking ring 30 is greater than the diameter of the shoulder 44, thereby allowing the shoulder 44 to effortlessly pass the latch lug 40, after the locking ring has passed the latch lug 40 as will be described below.

Figure 3:
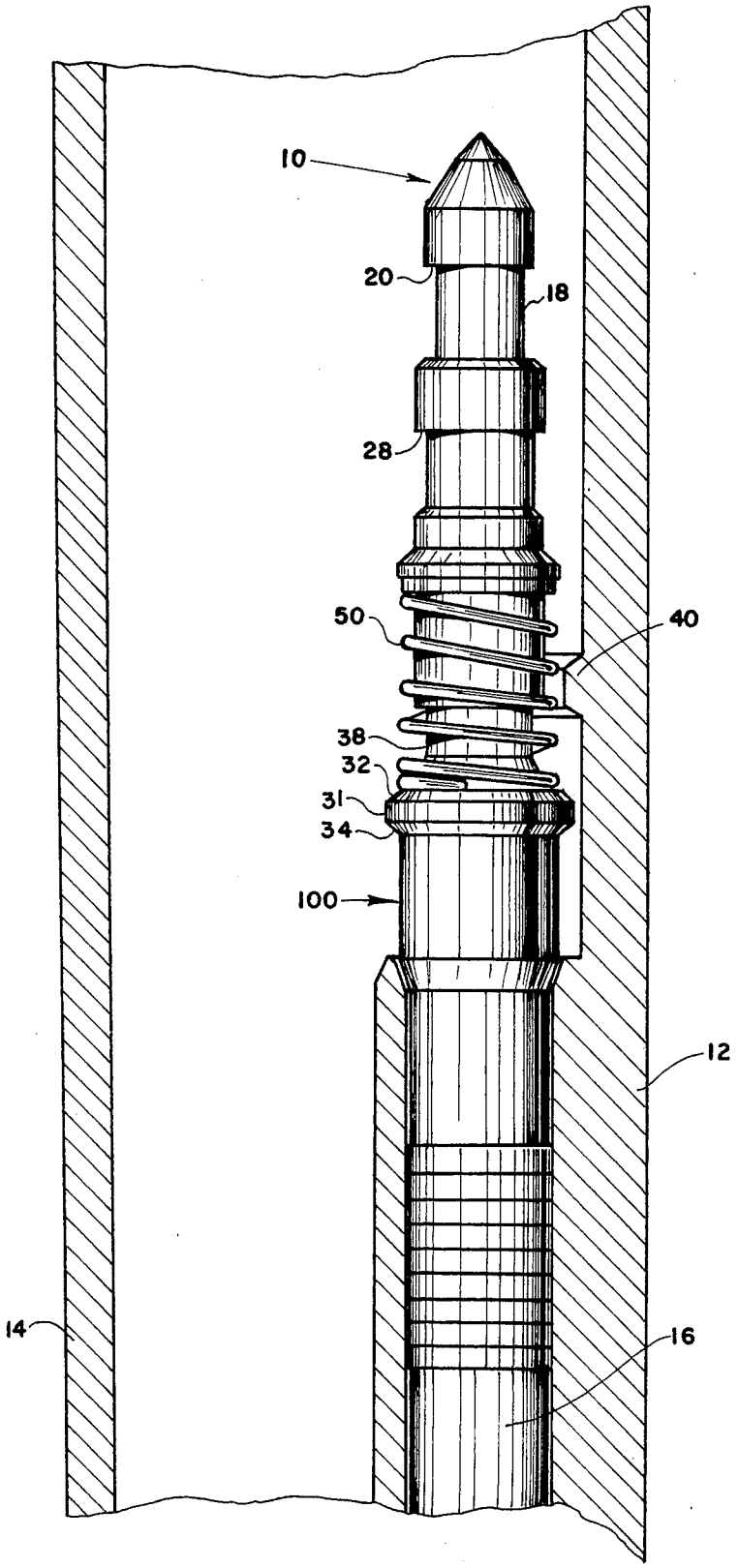
FIG. 3 is an elevational, partially cross sectional view, showing the position of the locking ring and of the released spring when the locking ring passes the locking shoulder of the tubular receiver.

As shown in FIG. 3, progressive downward movement of the flow control device 16 into the side pocket 12 results in positioning of the locking ring 30 below the latch lug 40. The compressed spring 50 releases, forcing the locking ring 30 downward, to its original position atop the latch sub 15, thereby locking the latch 10 and the flow control device 16 in the side pocket 12 of mandrel 14. The running tool (not shown) is then disengaged from shoulder 20 leaving the flow control device 16 inside the side pocket 12. The operation of the shoulder 44 is also described in my U.S. Pat. No. 3,827,493, issued on Aug. 6, 1974, the disclosure of which is incorporated herewith by reference.

Retrieval of the flow control device, under normal conditions, can be accomplished by conventional methods and tools, by engaging the upper shoulder 28, shearing the shear pin 26 and pulling the locking sleeve 24 upwardly. While the sleeve 24 slides upwardly on the body 18, the spring 50 releases, to some degree, leaving the locking ring 30 seated above the edge 17 of the flow control device 16 and below the enlarged diameter head 42 of the locking sleeve 24.

The lower bevel surface of the latch lug 40 is contacted by the complementary angle upper surface 32 of the locking ring 30, which then slides upward and, upon contact of the flat surfaces 41 and 31 of the latch lug 40 and the locking ring 30, respectively, moves laterally towards the body 18 to pass the latch lug 40 and allow retrieval of the flow control device 22 from its position in the side pocket 12 of mandrel 14.

In some circumstances, though, the flow control device, such as valve 16, cannot be retrieved by the above-described conventional method.

Sometimes, a latch post is parted at its threaded connection, the thread can be stripped or vibrated loose. When this occurs, the conventional retrieval tools are of little use, since there is no shoulder against which the latch can be pulled out. The latch is positioned inside the side pocket of a mandrel, and the retrieval means have been carried out to the surface. Yet, a valve has to be retrieved, it has a no-go latch sub mounted above it and it can be moved only in one direction-upward.

In accordance with the present invention, an improved retrieval means are provided for such emergency situations.

Figure 5:
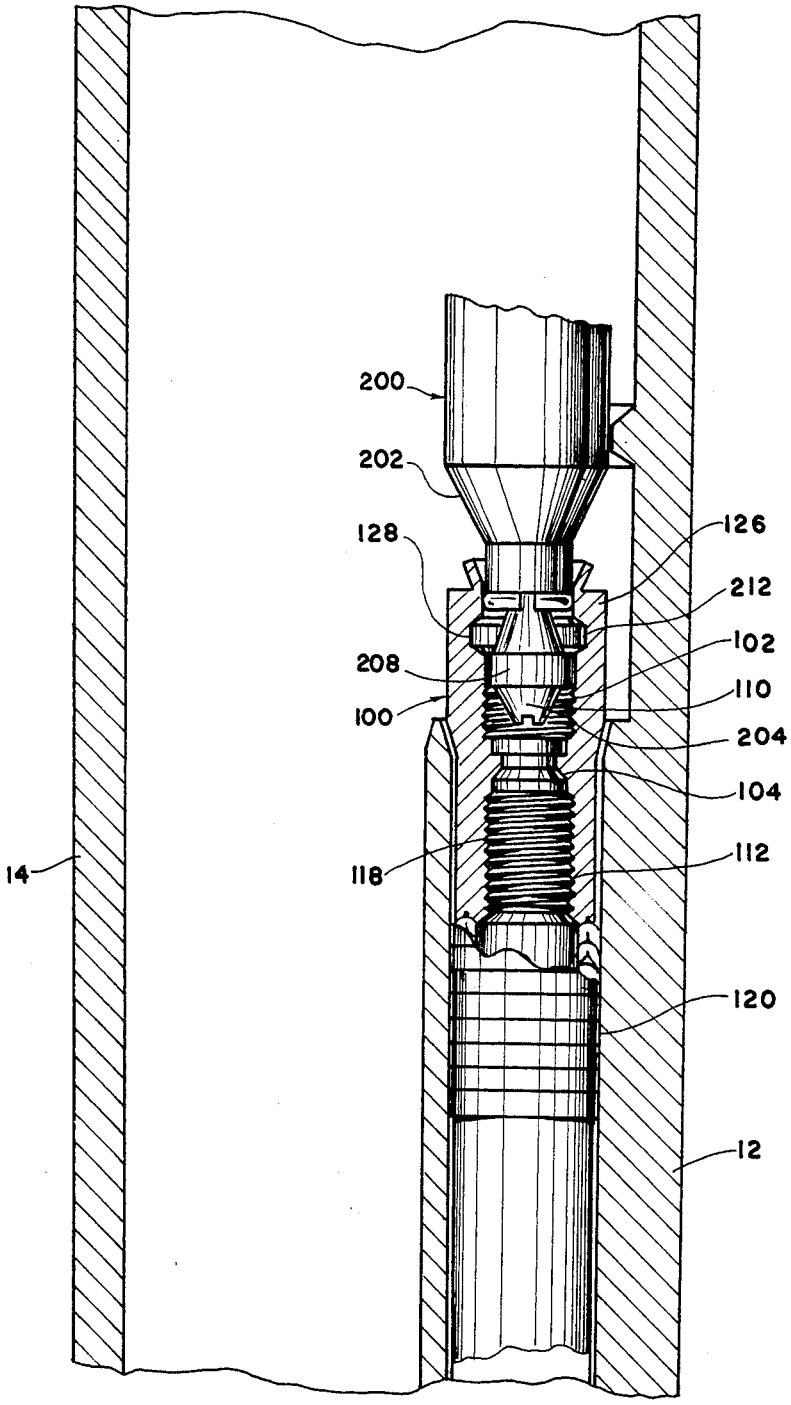
FIG. 5 is an elevational, partially cross sectional view showing a retrieval tool entering the central opening of a latch sub.
Figure 6:
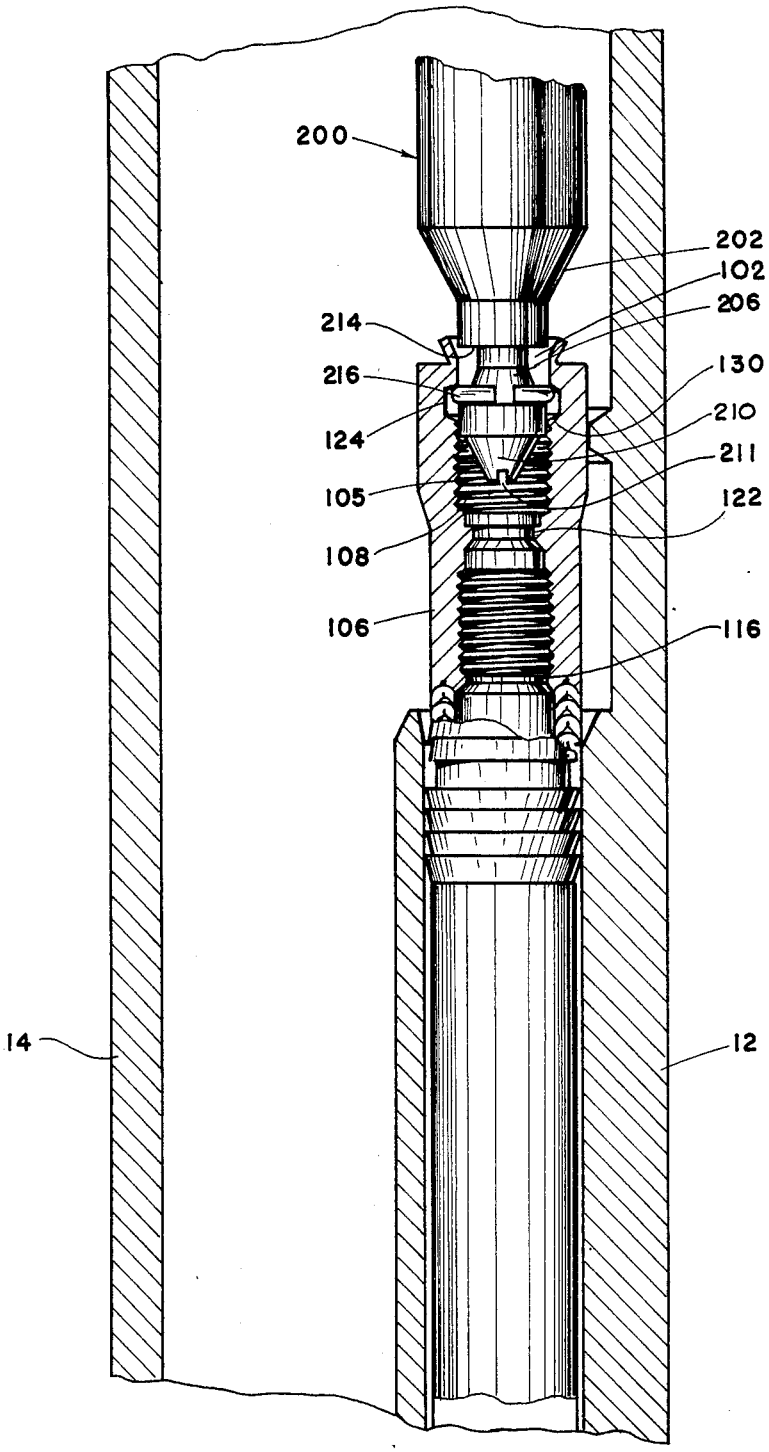
FIG. 6 is an elevational, partially cross sectional view of the retrieval tool, with the C-shaped locking ring locked in the internal recess of the latched sub.
Figure 7:
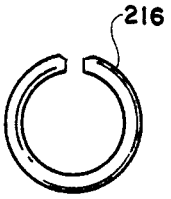
FIG. 7 is a plan view of the C-shaped ring in an expanded position.

FIGS. 5–6 show an improved retrieval means, comprising a retrieval tool as used in combination with an improved no-go sub of a locking latch. As was described above, this sub is left inside the side pocket when the stripping has been accomplished. The improved latch sub 100 comprises an upper 102 and lower 104 cavities formed by a central opening 105 which is made in the annular wall 106, the opening extending the length of the latch sub 100. The internal wall 108 of the opening is provided with an upper 110 and lower 112 threaded portions disposed in the upper 102 and lower 104 cavities, respectively.

The upper threads 110 terminate a distance below an uppermost edge of the latch sub 100 and are designed for engagement with matching threads (not shown) of a locking latch (not shown). The lower threads 112 extend substantially to the lowermost end 116 of the latch sub 100 and are designed for engagement with matching threads 118 of a valve 120, thereby ensuring a fixed position of the valve 120 in relation to a locking latch.

An internal annular rib 122 extends inwardly from and substantially perpendicularly to the internal wall 108 approximately midway between the uppermost edge and lower end 116 of the latch sub 100, dividing the central opening 105 into the upper 102 and 104 cavities, as was described above.

As further shown in FIG. 6, the internal wall 108 is provided with an annular recess means 124 above the upper threaded portion 110. The recess 124 is formed by an upper bevel surface 126, intermediate flat surface 128, having an enlarged diameter, and lower bevel surface 130.

An improved retrieval tool 200 which is utilized for retrieving the valve 120 in accordance with the present invention comprises a tool body 202 and a retrieval tool nose portion 204, which is fixedly and detachably connected (such as, for example, by threads) to the lower end of the tool body 202. Alternatively, the tool body 202 and the retrieval tool nose portion 204 can be made integral, forming a unit. The nose 204 comprises a first frustoconical portion 206, a middle, enlarged diameter cylindrical portion 208 and a second, downwardly facing frustoconical portion 210. A groove 211 is formed in the apex of the second frustoconical portion 210, the groove designed to receive torque, applied to the nose portion, as will be described in more detail below.

A lower shoulder 212 is formed by the top of cylindrical portion 208, and an upper shoulder 214 is formed by a lower end of the tool body 202 at the level of its engagement with a smaller diameter upper end of the first frustoconical portion 206.

A C-shaped locking ring means 216 is positioned in circumferentially surrounding relationship on the first frustoconical portion 206 and can move freely vertically between the vertical limits set by the upper shoulder 214 and the lower shoulder 212. Internal diameter of the C-ring 216 is such that it can move laterally, to some degree, on the frustoconical portion 206 but is prevented from sliding downward by the lower shoulder 212 and moving upward by an upper shoulder 214.

Operation of the retrieval tool 200 will now be described in reference to FIGS. 5 and 6.

As the retrieval tool 200 is lowered into the opening 105 of the latch sub 100, the nose 204 enters the cavity 102, and frustoconical portion 210 and cylindrical portion 208 pass through recess 124. The C-ring 216 collapses and moves through the opening 105 into recess 124, sliding along an upper bevel surface 126 into the middle portion 128, which, as was mentioned above, has a greater diameter than the overall diameter of the central opening 105, and which vertical dimensions are at least as great as the thickness of the C-ring 216.

After the C-ring has reached the middle portion 128 of the recess 124, it expands. Then a pulling force is applied to the retrieval tool 200, forcing the C-ring 216 to engage the lower shoulder 212 and rest on it, while sliding along the upper bevel surface 126 as can be seen in FIG. 6. The C-ring 216 is held in its expanded position, while the pulling force creates a shearing effect through the center of the C-ring 216, crosswise around its periphery.

In order to prevent shearing of the C-ring 216, it is designed and made of a high strength carbon steel wire which is strong enough to withstand the forces applied to the C-ring 216 during operation.

It should be noted that the material from which the C-ring is made is not limited only to the material mentioned above, but any material which possesses the same physical qualities will be acceptable, provided it can withstand the shearing force.

Continued application of the pulling force causes a positive locking effect between the retrieval tool 200 and the valve 120, after which the valve 120 can be retrieved from its position inside the side pocket and lifted to the surface. Upon arrival on the surface, the retrieval tool is separated from the valve 120 by first removing the latch sub 100, then applying torque to the portion 210 at the groove 211, thus separating the retrieval tool nose 204, latch sub 100 and the valve 120 from the retrieval tool body 202. The latch sub 100 can then be cut laterally through the annular wall 106 at the level of recess 124, after which the valve can be easily separated from the latch sub 100.

The foregoing disclosure and description of the invention is illustrative and explanatory thereof, and various changes may be made within the scope of the appended claims without departing from the spirit of the invention.

I claim:

1. A retrieval device for retrieving a valve stuck in a tubular receiver, comprising:

a substantially cylindrical housing having a central opening therethrough defined by an internal wall, the wall being provided with upper and lower threaded portions, the lower threaded portion being adapted for engagement with a matchingly threaded portion of the valve, the internal wall further having an internal recess means formed above the upper threaded portion;

a retrieval tool comprising a compressible C-shaped locking ring means circumferentially mounted on the exterior of a retrieval tool body and slidably axially movable along a part of said retrieval tool, said ring means being compressible by contact with the internal wall and being expandable when reaching the internal recess means, thus locking the retrieval tool with the valve to allow retrieval of the valve from the tubular receiver.

2. The device of claim 1, wherein said retrieval tool comprises a tool body and a nose portion and wherein the nose portion comprises an upper frustoconical part adapted for attachment to the tool body, a middle enlarged diameter cylindrical part and a lower frustoconical part, the upper and lower frustoconical parts each having a base of a diameter slightly smaller than a diameter of the middle part and each being integrally connected to the middle part at its respective base.

3. The device of claim 2, wherein the C-shaped locking ring means is mounted in surrounding relationship to the upper frustoconical part and is adapted for a limited axial movement between a shoulder formed by the middle part and a shoulder formed by the tool body.

4. The device of claim 3, wherein the middle part has an outside diameter substantially equal to that of the central opening.

5. The device of claim 4, wherein the lower frustoconical part has an apex and is provided with means for receiving torque at its apex.

6. A retrieval means for retrieving a well tool from a tubular receiver, comprising:

a substantially cylindrical body having a central opening therethrough and an internal wall which is provided with upper and lower threaded portions, the upper and lower threaded portions being separated by an annular shoulder projecting inwardly from the internal wall, the lower threaded portion being adapted for engagement with a matchingly threaded portion of the well tool, the internal wall further having an internal recess means formed above the upper threaded portion;

a retrieval tool comprising a tool body and a nose portion securedly attached to each other, the nose portion comprising an upper frustoconical part, a middle cylindrical part and a lower frustoconical part, the frustoconical parts each having a base and being connected to the middle cylindrical part at their respective bases; and a compressible C-shaped locking ring adapted for slidable axial movement about the exterior of the upper frustoconical part, the axial movement being limited by a lower end of the tool body and an upper end of the middle cylindrical part, the C-shaped locking ring being adapted for compression when passing through the central opening and adapted for release when the locking ring enters the internal recess means, thereby ensuring an effective locking of the retrieval tool within the cylindrical body.

7. The retrieval tool of claim 6, wherein a vertical dimension of the internal recess means is at least as great as the thickness of the C-shaped locking ring.

8. The retrieval tool of claim 7, wherein the internal diameter of the compressible C-shaped locking ring in expanded condition is smaller than a diameter of the base of the upper frustoconical part to prevent sliding of the locking ring past the middle cylindrical part.

9. A retrieval device for retrieving a well tool from a tubular receiver, comprising:

a substantially cylindrical body having a central opening and an internal wall provided with an internal recess means;

a retrieval tool carrying on the exterior thereof, in a limited axially sliding relationship, a compressible C-shaped ring means for locking engagement with the internal recess means formed in the internal wall of the cylindrical body;

means for attaching the retrieval device to the well tool.

* * * * *